United States Patent [19]

Bräuning

[11] 4,270,797

[45] Jun. 2, 1981

[54] ERGONOMIC CHAIR

[75] Inventor: Egon Bräuning, Weil am Rhein, Fed. Rep. of Germany

[73] Assignee: Protoned B.V., Amsterdam, Netherlands

[21] Appl. No.: 84,232

[22] Filed: Oct. 12, 1979

[30] Foreign Application Priority Data

Oct. 20, 1978 [CH] Switzerland ..... 10888/78

[51] Int. Cl.[3] ..... A47C 1/032

[52] U.S. Cl. ..... 297/300; 297/316; 297/305

[58] Field of Search ..... 297/300, 316, 321, 304–306, 297/319

[56] References Cited

U.S. PATENT DOCUMENTS

| | | | |
|---|---|---|---|
| 2,321,385 | 6/1943 | Herold | 297/305 X |
| 2,680,474 | 6/1954 | Fritz | 297/306 |
| 2,796,918 | 6/1959 | Luckhardt | 297/321 |
| 2,901,027 | 8/1959 | Dickson | 297/305 |
| 3,602,537 | 8/1971 | Kerstholt | 297/304 |
| 4,170,382 | 10/1979 | Wheeler | 297/306 |

*Primary Examiner*—Francis K. Zugel

*Attorney, Agent, or Firm*—Ladas & Parry

[57] ABSTRACT

The ergonomic chair comprises at the upper end of the chair column, a supporting arm on which the front end of the seat supporting frame is articulated for pivoting vertically. At the rear end of the seat supporting frame, a back rest is connected to the seat supporting frame and the supporting arm by means of a movement guiding and return mechanism so that an alteration in the inclination of the back rest automatically causes a proportional alteration in the inclination of the seat supporting frame. The movement guiding and return mechanism is divided into two structural units which are separate in construction. The one is a linkage mechanism which is effective between a back-rest connection construction, the seat supporting frame and the supporting arm, with a movement lock which is effective when the chair is in the position of rest. The other structural unit is constructed in the form of a spring mechanism which can be locked and which applies a force to the chair column between the back-rest connection construction and the supporting arm, through which the back rest and the seat supporting frame are restored from a backwardly inclined position into a normal initial position.

4 Claims, 4 Drawing Figures

Figure 1:
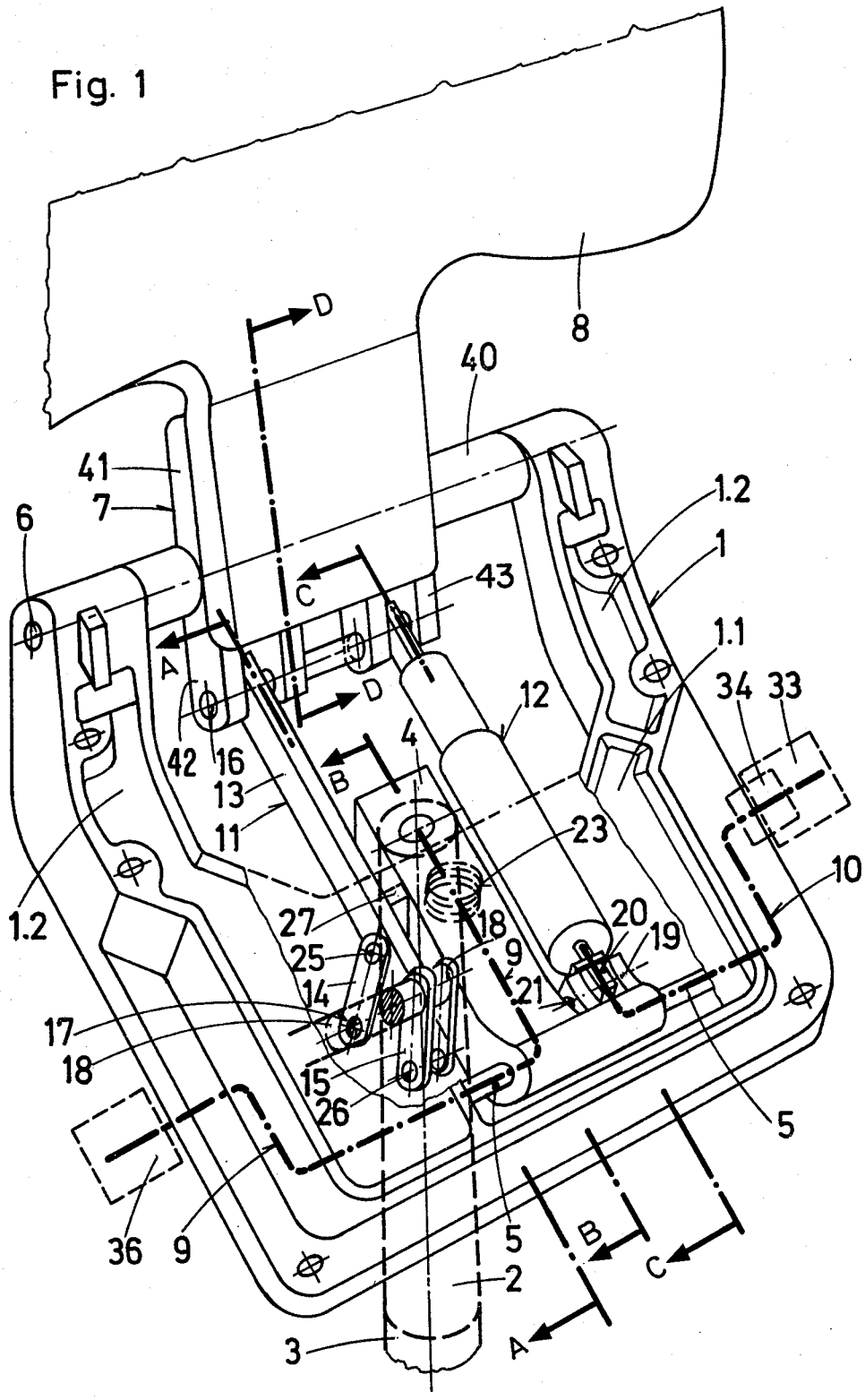

41
7
40
6
44
48
50
46
C
47
42,43
51
B
45
16

41
7
42
48
50
50
49
43
40
16
47
11
46
16
12

ERGONOMIC CHAIR

The invention relates to an ergonomic chair in accordance with the preamble to claim 1.

Chairs designed from the ergonomic point of view aim primarily at supporting the body of the user of the chair with as little fatigue as possible even with different postures. This presupposes that the chair has means which can be adapted to the movements and the anatomy of the human body so that the person sitting in the chair can select the correct seat for his particular requirements or in order that the seat may be brought into a relationship which is at least substantially correct for the body in relation to the back rest. For this purpose, a number of constructions are already known wherein a correct body support is intended to be achieved by means of lever mechanisms and spring means which are fixed and connected in series or parallel or which can be adapted by manual actuation. Examples of such mechanisms can be seen from the CH-PS No. 524 982 and the DE-OS No. 27 33 322. It is characteristic of these chairs that with freely movable spring means, the adaptation of the relative position between seat and back rest, caused by the arrangement of the pivot points and points of action of the seat in relation to the seat or chair column, is effected depending both on the seat load and the back-rest load, from which a swinging of the body supporting parts of the chair can result. The required position of equilibrium and "hardness" can be selected by suitable adjustment of the spring means—preferably a gas spring. Meanwhile it was recognized that, for comfortable sitting, it is undesirable for the adjustment and spring mechanism to start moving on initial loading of the seat and of the back rest, because with frequent standing up and sitting down, the user of the chair becomes fatigued rather than having a feeling of relief.

The object of the invention is therefore, starting from a chair of the kind referred to at the beginning, to construct this, by appropriate design of the seat, back-rest adjusting mechanism so that even with free spring means the seat can be loaded without immediate beginning of the resilient downward movement of the rear section of the seat. In other words: One should sit on the chair according to the invention as on a work chair with a seat which is stable in inclination and be able to load its rear portion situated behind the point of action of the chair column without a change in inclination occurring. Instead, this should only occur when the back rest is urged backwards by the user, overcoming a certain force threshold, in which case the proportional adjustment of the seat and back-rest inclination usual in ergonomically designed chairs results. When the back rest is relieved, this is restored to its initial position with synchronous movement of the seat. The chair or its adjustment mechanism should be able to be locked selectively in required positions.

The solution to this problem is characterised by the features of claim 1.

The main advantage in comparison with the former chairs constructed from ergonomic points of view lies in the fact that the spring member now no longer lies in a series or parallel connection in relation to the actual movement mechanism but is installed directly between a component which does not participate in the adjustment movement of the chair and the back rest. The spring member therefore no longer needs to be dimensioned according to the mechanical requirements of the adjusting mechanism. As a result, the adjustment difficulties are eliminated which often arose in determining the adjustment forces to be adapted to the weight of the user of the chair. The standard installation of overdimensioned and/or complicated spring members can be eliminated because of the relatively simple connecting up of easily adjustable additional springs. The spring members, which are in danger of wear, are relatively easy to replace because only this one component is affected by dismounting. With the usual use of gas springs there is the additional fact that problems of space and cost can be solved considerably more favourably by the use of smaller units. Above all the smaller space requirements not only for the spring members but also for the actual movement mechanism, renders possible a considerably better formation.

Figure 2A:
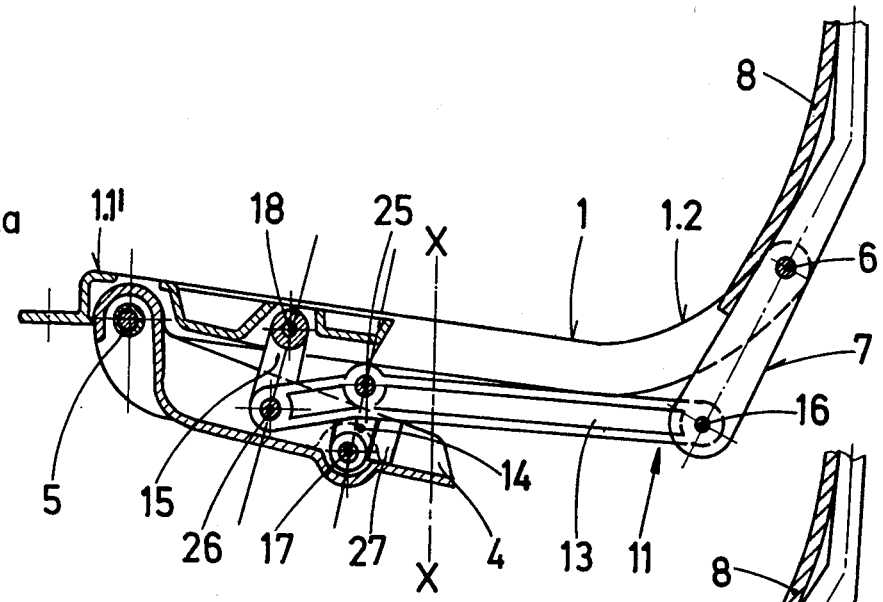
Figure 2B:
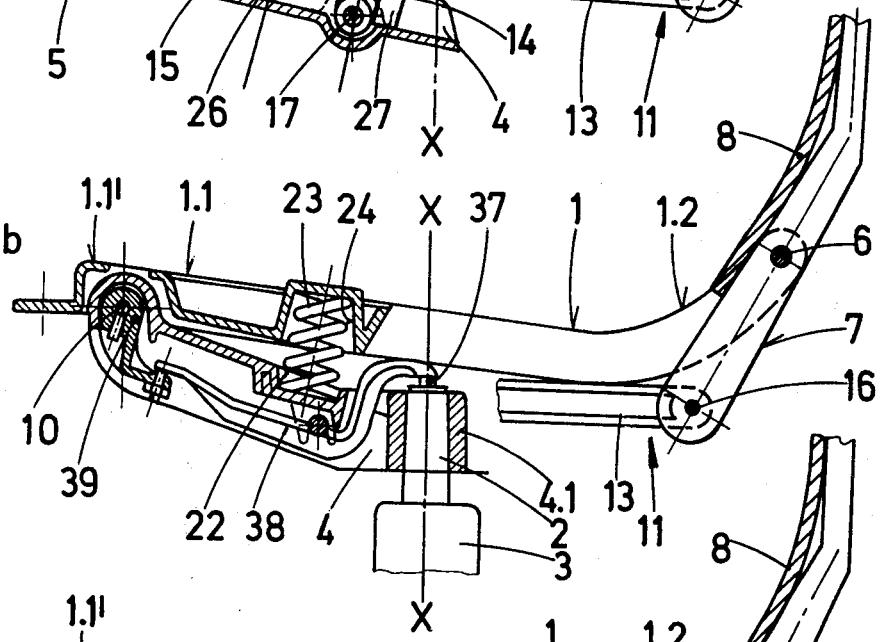
Figure 3A:
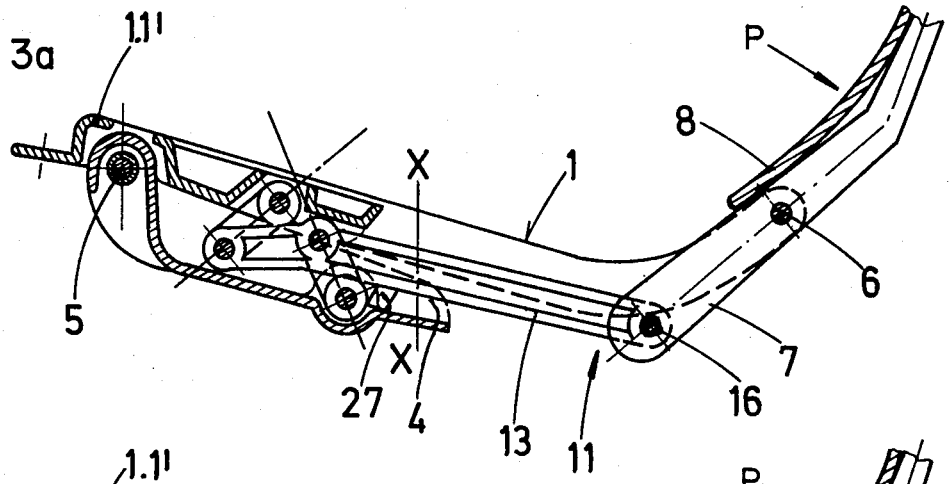
Figures 4A, 4B:
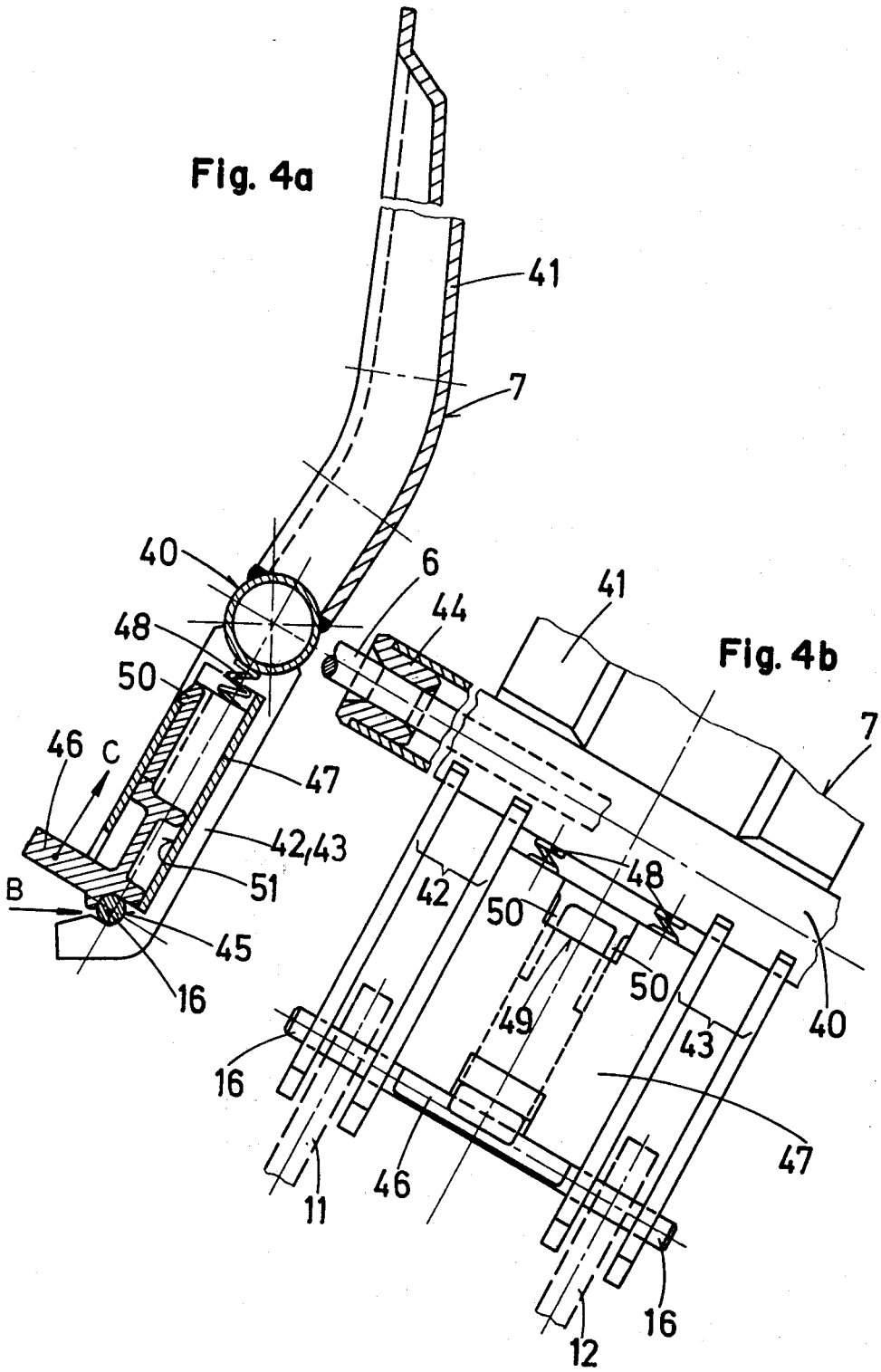

The subject of the invention is explained in more detail below with reference to an example of embodiment. In the accompanying drawing:

FIG. 1 shows in a diagrammatic perspective illustration, the seat supporting frame, the back rest articulation and the connecting elements between chair column, seat frame and back rest, FIGS. 2*a, b, c* show sections on the lines A—A, B—B and C—C in FIG. 1 with the chair unloaded or the back rest unloaded and at a steep angle with the seat supporting frame lying relatively level, FIGS. 3*a, b, c* show sections on the lines A—A, B—B and C—C in FIG. 1 with the chair loaded or the back rest loaded and inclined towards the rear and the seat supporting frame inclined towards the rear, and FIGS. 4*a, b,* show a section on the line D—D in FIG. 1 (1) and a plan view (b) in the direction of the arrow A in FIG. 4*a* to illustrate the back rest connection to the articulation and spring mechanism of the chair.

In the diagrammatic perspective illustration in FIG. 1, 1 designates in general a seat supporting frame which is pivotally mounted in pivots 5 on a supporting arm 4 which is placed on the head end 2 of a central chair column 3 and which is shown simplified but in reality is divided up as in FIGS. 2*a,* 2*b,* 3*a,* 3*b.* The seat supporting frame 1 has a flat front portion 1 which is provided with reinforcing ribs and apertures, not designated and of which the central portion is broken away, and a rear portion which is equipped with two fork carriers 1.2 and on the ends of which, the connection construction 7 of the back rest 8 is pivotally mounted on a shaft 6. The pivots 5 are hollow stub shafts which are secured in cast eyes (not shown) of the seat supporting frame and guide in their bores control linkages 9 and 10, indicated diagrammatically by broken lines, of an adjusting mechanism later described in detail. The main components of this adjusting mechanism, which renders possible a pivotal movement of the seat supporting frame and back rest construction both in relation to one another and in relation to the chair column 3, are, on the one hand a guide and locking linkage device 11 illustrated in FIGS. 2*a* and 3*a* and on the other hand a spring mechanism 12 shown more precisely in FIGS. 2*c* and 3*c*. While the guide and locking linkage device 11 consisting of a plurality of lever members 13, 14 and 15 described below is connected on the one hand through a pivot pin 16 (see also FIG. 4*b*) to the lower end of the back-rest connection construction 7 and on the other hand through a pivot pin 17 to the supporting arm 4 (see also FIGS. 2*a,* 3*a*) and a pivot pin 18 to the seat supporting frame 1, the spring mechanism 12 lies between the pivot pin 16 traversing the connection construction 7 and a connection block 19 present on the supporting arm 4, on which it is anchored by a suspension structure 20 not shown in more detail, with a pin 21. In this connection see also FIGS. 2*c* and 3*c*. From this it follows that a forward-backward pivotal movement of the back rest simultaneously leads to an alteration in the inclination of the seat supporting frame 1 in relation to the supporting arm 4. The spring mechanism 12 is only effective between the seat supporting frame 1 and the back-rest connection construction 7. It may further be mentioned that the spring mechanism 12 in the example shown is shown as a gas spring which is adjustable with regard to its piston stroke and which can be used both as a spring element and as a locating member for fixing the inclination of the seat supporting frame and back rest.

Figure 2C:
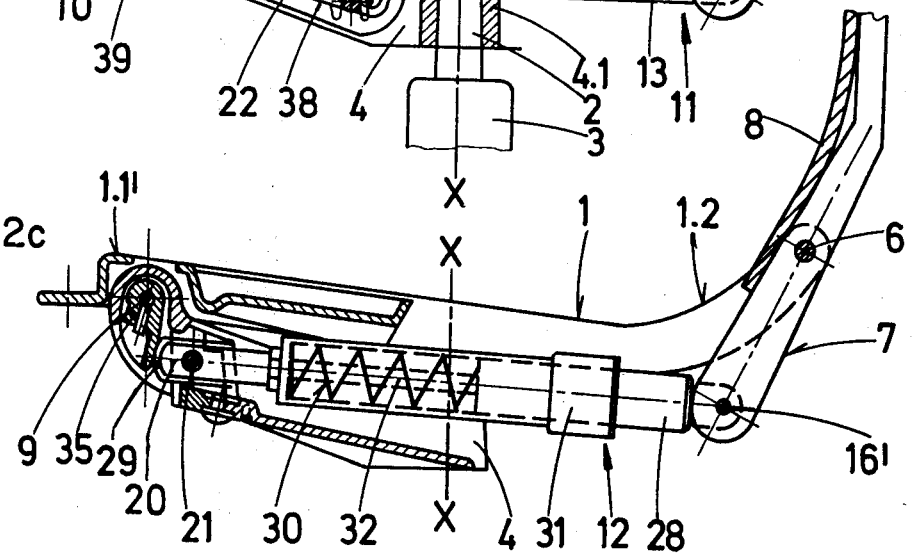
Figure 3B:
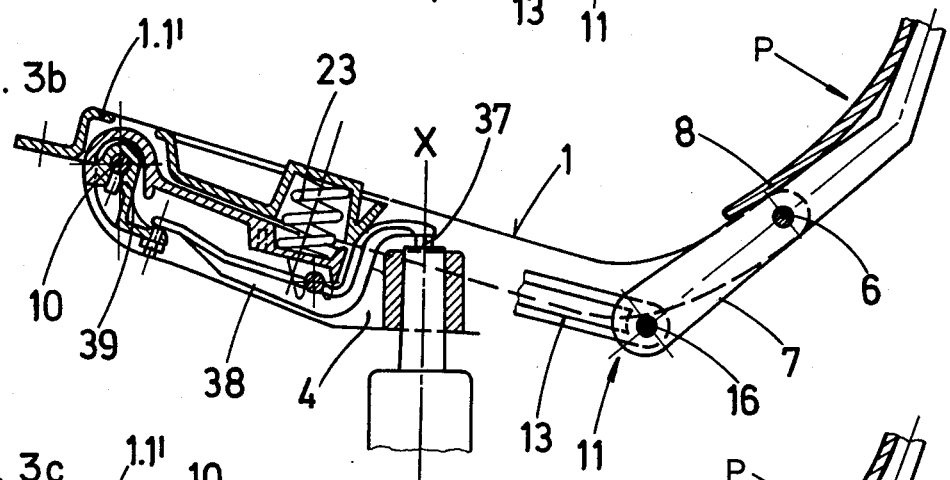
Figure 3C:
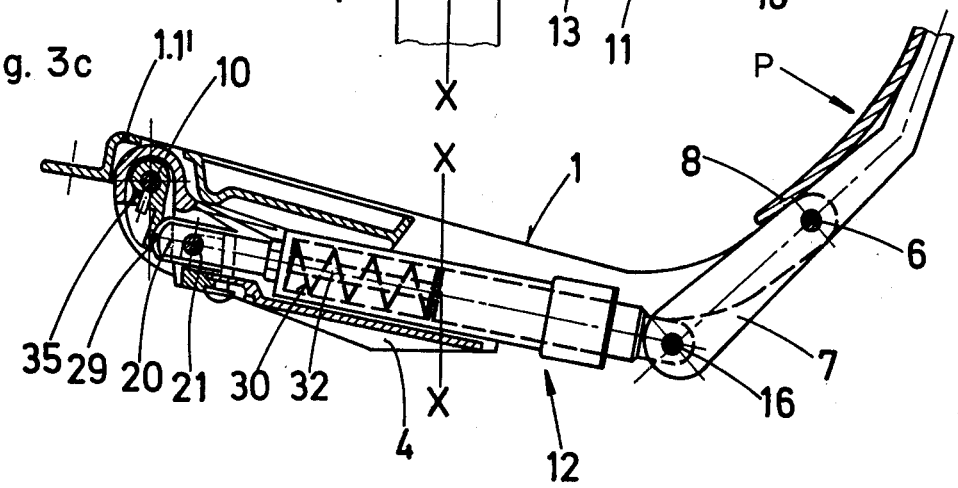

The components participating in the adjustment of the seat supporting frame 1 in relation to the back rest 8 or its connection construction 7 and their supporting and receiving members can be seen in greater detail from FIGS. 2*a–c* and 3*a–c*. The parts of the Figures designated by the letters a, b and c correspond to section illustrated with more detail on the lines A—A, B—B and C—C in FIG. 1, and FIGS. 2*a–c* show the components in the position of rest or initial position of the chair (normally raised back rest) and FIGS. 3*a–c* show the same components in the position of the back rest inclined towards the rear in the extreme. Like parts are provided with the same reference numerals in all the Figures.

In FIGS. 2*a–c* and 3*a–c*, 1 again designates the seat supporting frame, the front end 1.1′ of which is pivotally mounted on the supporting arm 4, for example of frame-shaped construction, by means of the hollow pivots 5 visible only in FIGS. 2*a*, 3*a*. The supporting arm 4 has at its inner end a seat cap 4.1 with a slightly tapered bore. The seat cap 4.1 surrounds the head end 2 of the chair column 3 or a gas spring (not shown) which is installed in this for adjustment in height. Thus the supporting arm 4 has a defined position with respect to the chair column, which does not alter even when the seat portion of the chair is turned about the column axis x—x. Furthermore, the front portion 1.1 of the seat supporting frame 1 is supported on the supporting arm 4 by means of a powerful helical spring 23 centred in a spring seat 22 at its top. The frame 1 is provided with another spring seat 24 to receive the other end of the spring. The spring 23 is so dimensioned that it is capable of transmitting a great proportion of the body weight of the user of the chair directly from the seat supporting frame to the supporting arm and so of relieving the guide and locking linkage device.

The rear (forked) end 1.2 of the seat supporting frame 1 carries, by means of the shaft 6, the connection construction 7 shown diagrammatically in FIGS. 2*a–c* and 3*a–c* together with the back rest 8. Details are described later with reference to FIG. 4. At the lower end of the connection construction which is there shown likewise fork-shaped, one end of the two-armed steering lever 13 is connected to the pivot pin 16. Its pivot point situated near the other end of the lever is the centre of a pivot 25 which engages in the receiving bore of one of the lever links 14 at its ends projecting at both sides beyond the steering-lever faces. The links of this first pair of links comprise, at their other end, a second receiving bore, through which the steering lever 13 is articulately mounted on the supporting arm 4 by means of the pivot pin 17. At the end of the shorter lever arm of the steering lever 13, this comprises a further bore to receive a pivot pin 26 which engages, at its ends projecting beyond the steering lever faces at both sides, in the receiving bore of each of the lever links 15. The links of this second pair of links comprise, at the other end of the link, a second receiving bore through which the steering lever 13 is articulately mounted on the seat supporting frame 1 through the pivot pin 18. The system formed by the pivot members 6, 16, 25, 17, 26, 18 and the lever sections of the guide and locking linkage device 11 situated in between renders possible a downward movement of the rear portion of the seat supporting frame on pivoting of the back rest 8 in clockwise direction, as can be seen from FIG. 3*a*. In order to avoid pivoting of the back rest 8 in clockwise direction on mere loading of the seat supporting frame 1, the axes of the pivot pins 17, 18, 25, 26 of the first and second pairs of links 14, 15 must initially stand in relation to one another so that a self-locking results through these pairs of links. This is the case when the longitudinal axes of the pairs of links lie parallel in FIG. 2*a*, but preferably diverge upwards, that is to say towards the seat. In this case, at least one of the links 14 bears against a stop 27 connected to the supporting arm 4, which limits the pivoting of the pair of links 14 in clockwise direction and so determines the maximum steep position of the back rest. It also leads to a stable position of the seat supporting frame 1 in relation to the supporting arm 4 in the initial position or position of rest. It should be noted that with this a relatively low constructional height of the construction of the locking mechanism rendering possible the guide and linkage device lies in front of the vertical column axis x—x on the chair.

If the back rest 8 or its connecting construction 7 is pivoted in clockwise direction about the shaft 6 by applying a force P, as shown in FIG. 3*a*, then the steering lever 13 is displaced towards the left through the pivot pin 16, as a result of which the position of the longitudinal axes of the pairs of links 14, 15 alters beyond the parallel position into directions converging upwards. In the course of this the locking action of the pairs of links 14, 15 is cancelled. At the same time, the seat supporting frame 1 pivots about the pivot 5 in the region of its front end 1.1 in relation to the supporting arm 4 and the frame plane is inclined backwards and downwards.

During this process, as a result of the downward movement of the seat supporting frame 1, the spring 23 is pressed in as shown in FIG. 3*b*. As already mentioned, this spring serves to compensate for the greater part of the vertical component of the bearing weight on the chair, in order to relieve the spring mechanism 12.

The "stable" position of the guide and locking linkage device 11, shown in FIG. 2*a*, is ensured by the spring mechanism 12, shown in more detail in FIGS. 2*c* and 3*c*, which applies a compressive force between the pivot pin 16 traversing the back-rest connection construction 7 (see also FIG. 4) and the suspension pin 21 acting on the supporting arm 4 at the left-hand side (front) end of the spring mechanism. As a result, the connection construction 7 is loaded in counter-clockwise direction and so also the steering lever 13 (FIGS. 2*a*, 3*a*) is pulled so far towards the right that the link 14 comes to bear against the stop 27.

In the present example, the spring mechanism 12 contains a gas spring 28 at the piston end of which the suspension structure 20, not shown in detail, is placed with an end member 29 to control the gas spring. The compressive force of the gas spring 28 can be amplified by a compression spring 30. Its initial tensioning force is adjustable infinitely variably by means of an adapter sleeve 31 engaging over the gas spring 28 and the compression spring 30 and mounted for rotation on a threaded spindle (not shown). The piston rod 32 of the gas spring 28 is freely movable or can be controlled in a locking position in known manner. In the example shown, the control linkage 9 which is mounted in the hollow pivot 5 (FIG. 1) serves for this, the actuating end of which is provided with a handle 33 projecting laterally beyond the seat supporting frame and a blocking slide 34 while its end at the spring side carries a cam 35 which acts on the control end member 29 of the gas spring (FIGS. *2c, 3c*).

The control means of the gas spring 28 is described permit, on the one hand the relative position between the surface of the seat or the seat supporting frame and the back rest to be locked in any position in its range of movement and, on the other hand—with the piston rod freely movable—the inclination of the back rest and the seat surface to be adapted automatically to the particular requirements by the user of the chair urging the back rest back.

It is understood that the spring mechanism 12 can also be constructed otherwise. In particular, the arrangement shown is not restricted to the use of a gas spring, but may instead be provided with spring means which give the same or similar spring characteristics. The same also applies to the suspension and height adjustment construction in the chair column 3 which, in the example shown, is likewise directed to the use of a gas spring (not shown). Provided for its control, as shown diagrammatically in broken lines in FIG. 1 and in more detail in FIGS. *2b* and *3b*, is the control linkage 10 which is provided at its actuating end (FIG. 1) with a handle 36 projecting laterally beyond the seat supporting frame. The other end of the control linkage 10 comprises, to act on the control pin 37 of the chair-column gas spring, a pressure lever 38 which is pivotally mounted on the supporting arm 4 and on which there acts a cam 39 mounted on the control rod traversing the pivot 5 (FIG. 1). (FIGS. *2b, 3b*).

Provided for the mounting of the back rest 8 on the forked rear end 1.2 of the seat supporting frame 1 is a connection construction as shown in FIGS. 1 and 4, wherein upwardly projecting connecting plate 41 to secure the back rest and two downwardly directed fork carriers 42, 43 are welded onto a horizontal supporting tube 40. One pair of these fork carriers is intended for the connection of the guide and locking linkage device 11, the other for the connection of the spring mechanism 12. Bearing bushes 44 are inserted in the ends of the supporting tube 40 to centre the back-rest pivot shaft 6.

Although the connection of the linkage device 11 and of the spring mechanism 12 to the fork carriers 42, 43 may be effected in a simple manner by means of the pivot pin 16 inserted in through openings (or two pins associated with each fork carrier), it may be advisable to provide a coupling device which can be released without a tool for this. In this case, the fork carriers 42, 43 comprise instead of a pin bore (not shown) a fork groove 45 which is open towards the front and provided with a receiving undercut and in which the pivot pin 16 is inserted from the front (arrow B). With this procedure, a clamping slide 46 which urges the pin 16 into the undercut and which is mounted for displacement in a housing 47 is pushed upwards in the direction of the arrow C against the pressure of springs 48. The clamping slide 46 is held captive in the slide compartment 51 of the housing 47 by spring tongues 50 which can be brought into abutment with a housing edge 49.

What is claimed is:

1. An ergonomic chair having a chair column (3) which is adjustable in height, a supporting arm (4) fitted to the upper end of the chair column, a seating supporting frame (1), the front end region of which is articulated for vertical pivoting (at 5) on the radially outer end of the supporting arm, a backrest (8) articulated on the rear end (at 6) of the seat supporting frame (1) and connected for movement with the seat supporting frame and the supporting arm through a connection construction (7) and a movement guiding and return mechanism (11, 12) so that an alteration in the inclination of the back rest automatically causes a proportional alteration in the inclination of the seat supporting frame, characterised in that the movement guiding and return mechanism is composed of (a) a first structural unit (11) having a two-armed steering lever which is connected at its rear end (at 16) to the back-rest connection construction (7), and the pivot point (25) of which is connected through a first pair of links (14) to said supporting arm (4) and the front end of which (at 26) is connected through a second pair of links (15) to the seat supporting frame (1), and (b) a second structural unit in the form of a compression-spring device (12) which can be adjusted by reaction force and which is effective between the back-rest connection construction (at 16') and the supporting arm (at 21) and which is intended to urge the back rest (8) into the position with the least inclination;

and that in order to secure this position of least inclination a movement limiting stop (27) is provided which is effective between the first structural unit (11) and the supporting arm (4) and on action upon which the longitudinal axes of the first (14) and of the second (15) pair of links lie at least parallel to one another but preferably diverging upwards, in order to form a locking mechanism which is automatically effective for vertical loads acting on the seat supporting frame and which can be released by swinging back the back rest.

2. An ergonomic chair as claimed in claim 1, characterised in that in order to relieve the movement guiding and return mechanism (11, 12) of a considerable proportion of the bearing load acting on the seat supporting frame (1), a compression spring (23) is installed between this frame and the supporting arm (4).

3. An ergonomic chair as claimed in claim 1, characterised in that the seat supporting frame (1) is constructed in its front section (1.1) in the form of a plate provided substantially with reinforcing ribs and in the rear part (1.2) in fork shape, that the back-rest connection contruction (7) comprises a horizontal supporting tube (40) which is inserted pivotally between the fork ends of the seat supporting frame and the top of which carries a frame connection plate (41) and the under side of which is provided with fork-shaped elements (42, 43) for the connection of said first and second structural units (11, 12) to the back-rest connection construction.

4. An ergonomic chair as claimed in claim 4, characterised in that the fork-shaped connection elements (42, 43) are provided at their radially outer ends with receiving grooves (45) with an undercut groove bottom for the engagement of a pivot pin (16) extending through the connection ends of the structural units (11, 12) and that a spring-loaded clamping member (46), which urges the pivot pin (16) into the bottom of the groove, holds this in the forked-shaped connection elements.

* * * * *